United States Patent [19]

Hinckley

[11] Patent Number: 4,939,511

[45] Date of Patent: Jul. 3, 1990

[54] DC BUS FOR DISCRETE SIGNALS

[75] Inventor: Paul H. Hinckley, Hicksville, N.Y.

[73] Assignee: Grumman Aerospace Corporation, Bethpage, N.Y.

[21] Appl. No.: 290,043

[22] Filed: Dec. 27, 1988

[51] Int. Cl.[5] ..... G08B 21/00

[52] U.S. Cl. ..... 340/825.78; 340/825.77; 341/26

[58] Field of Search ..... 307/100, 106; 340/825.77, 825.78; 341/26

[56] References Cited

U.S. PATENT DOCUMENTS

| | | | |
|---|---|---|---|
| 3,872,436 | 3/1975 | Yoshida | 340/825.78 |
| 4,118,700 | 10/1978 | Lenihan | 307/100 |
| 4,340,824 | 7/1982 | Shaw | 340/825.77 |
| 4,430,576 | 2/1984 | Fowler | 340/825.77 |
| 4,575,714 | 3/1986 | Rummel | 340/825.78 |
| 4,580,138 | 4/1986 | Morrison | 340/825.78 |
| 4,583,189 | 4/1986 | Koyama | 341/26 |
| 4,695,840 | 9/1987 | Darilek | 340/825.77 |

*Primary Examiner*—Donald J. Yusko
*Assistant Examiner*—Eric Oliver Pudpud
*Attorney, Agent, or Firm*—Scully, Scott, Murphy & Presser

[57] ABSTRACT

A DC bus circuit is disclosed for coupling multiple discrete signals from multiple discrete signal sources with multiple receivers remote from the signal sources. Each multiple signal source has two discrete positions or levels, such as opened or closed, and each signal source has an encoding resistor in series therewith, with no active components. Each encoding resistor has an ohmic value which is a discrete power of two times a reference resistor, and each signal source transmits its signal by grounding or ungrounding its resistor. Each multiple receiver is connected to its corresponding remote signal source by a common DC bus, and each receiver has a decoder circuit which compares the voltage on the DC bus with a reference voltage generated by a pair of reference resistors.

4 Claims, 8 Drawing Sheets

DC BUS FOR DISCRETE SIGNALS

BACKGROUND OF THE INVENTION

1. Field of the Invention

The present invention relates generally to a circuit arrangement for reducing the wiring required between discrete signal sources and remote receivers therefor in any military or commercial system using multiple discrete signals.

2. Discussion of the Prior Art

Many discrete electrical signals are used in aircraft and similar complex operating systems. These signals are usually in the form of switch closures to ground or to some DC voltage, and each discrete signal normally requires a minimum of one wire per signal.

In complex electrical/electronic systems such as those aboard an F-14D aircraft, many discrete signals are transmitted from remote switches or various signal sources to other pieces of equipment in the system. These discrete signals are usually in the form of DC voltages or switch closures. In a system of the complexity of the F-14D, for example, a minimum of one wire is required for each discrete signal (if the airframe frame is used as a ground for the signal return). This translates into hundreds of wires routed throughout the aircraft carrying these discrete signals, and each wire adds to the weight and complexity of the aircraft wiring harnesses. In addition, where electromagnetic interference is a consideration, each wire often requires a separate filter therefor for filtering.

To reduce the wiring between units, many signals are now being transmitted over a bus system. In vehicles such as the F-14D aircraft and Trident submarines, this bus system is defined by military specification MIL-STD-1553. The MIL-STD-1553 bus system is a complex pulse-coded system capable of transmitting digital data. However, the MIL-STD-1553 bus requires a digital transmitter at each signal source and a digital receiver at each receiving end. The MIL-STD-1553 bus also requires shielded twisted-pair wires to prevent electromagnetic interferences (EMI). Most MIL-STD-1553 buses also require isolation transformers to couple to each piece of equipment on the bus.

SUMMARY OF THE INVENTION

Accordingly, it is a primary object of the present invention to provide a bus circuit arrangement for reducing the wiring required between discrete signal sources and their remote associated receivers.

A further object of the subject invention is the provision of a circuit arrangement in the form of a DC bus for discrete signals which has the following advantages:

(1) It can carry multiple discrete signals on a single unshielded wire instead of a shielded twisted pair of wires.

(2) Only one encoding resistor in series with a switch is required at each signal source. No active components (transistors, microcircuits, etc.) are required. This eliminates the need for additional power supplies and EMI filters since resistors and switches are passive devices.

(3) Isolation transformers are not required.

(4) Because the bus is a DC system addressing a high-impedance receiver, EMI filtering at the receiving end may be accomplished by means of simple RC filters.

In accordance with the teachings herein, the present invention provides a DC bus for discrete signals in which each signal source is encoded by a resistor that is some power of two times a reference resistor, and each signal source transmits its signal by grounding or ungrounding its resistor. Embodiments of the present invention with other relationships between the values of the resistors, such as a multiple greater than a power of two, are possible, but a power of two relationship is preferred.

Accordingly, the DC bus for discrete signals of the present invention can be used to reduce the wiring and also EMI filtering of aircraft and other complex operating systems. It has been estimated that up to eight separate discrete signals may be carried on a single bus. The DC bus for discrete signals of the subject invention may also be used in alarm or interlock circuits as a simple means to identify individual switch closures.

The present invention allows multiple signals to be carried on a single wire. Because the signals are essentially at DC levels, it is possible to heavily filter the DC Bus at the receiving end to eliminate electromagnetic interference. The signal sources are encoded with simple inactive devices such as impedances such as resistors (or capacitors or inductors in corresponding AC circuits for circuit simplicity at the source end.

In accordance with a preferred embodiment, a bus circuit is disclosed for coupling multiple discrete signals from multiple discrete signal sources with multiple receivers remote from the signal sources. Each multiple signal source has two discrete positions or levels, such as a switch which is opened or closed, and each signal source has an encoding impedance in series therewith, with no active components. Each encoding impedance has an impedance value which is a discrete power of two times a reference impedance, and each signal source transmits its signal by grounding or ungrounding its impedance. Each multiple receiver is connected to its corresponding remote signal source by a common DC bus, and each receiver has a decoder circuit which compares the voltage on the DC bus with a reference voltage generated by at least one reference impedance. In a preferred embodiment, each impedance comprises a resistor, and the reference voltage is generated by a pair of reference resistors.

BRIEF DESCRIPTION OF THE DRAWINGS

The foregoing objects and advantages of the present invention for a DC bus for discrete signals may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
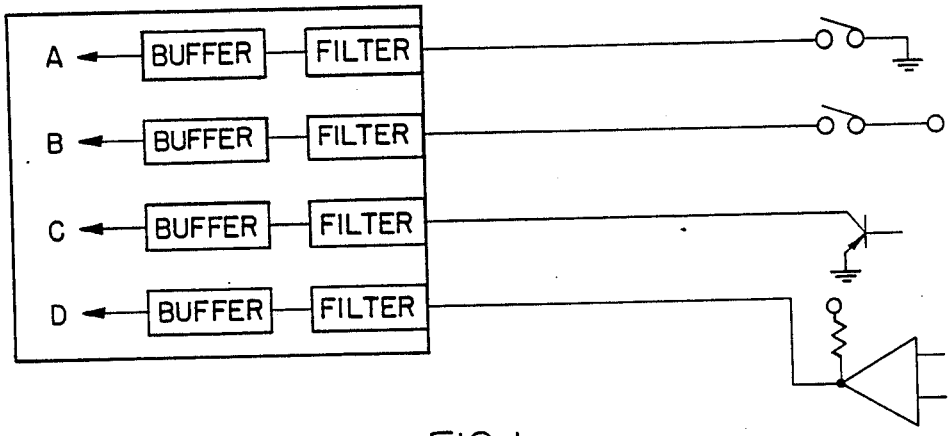
FIG. 1 (PRIOR ART)
FIG. 1 illustrates a prior art system utilizing discrete signals.

Referring to the drawings in detail, FIG. 1 illustrates a prior art system utilizing discrete signals, in which each of a variety of remote signal sources is coupled with an associated receiver by a separate line, which could be a single or twisted pair wire line as discussed hereinabove.

Figure 2:
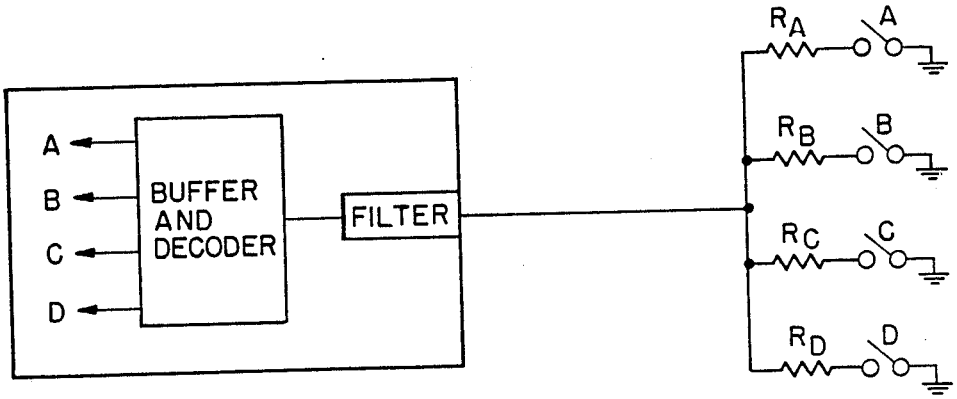
FIG. 2 (PRIOR ART)
FIG. 2 illustrates a DC bus for discrete signals pursuant to the teachings of the present invention.

FIG. 2 illustrates a DC bus for discrete signals pursuant to the teachings of the present invention. In FIG. 2, each signal source switch A, B, C and D is identified means of a coding resistor $R_A$, $R_B$, $R_C$, and $R_D$. Only a single line is needed between the switches and the equipment receiving the discrete signals, and only one EMI filter is required. In the receiving equipment, the signals are decoded in a buffer and decoder to generate outputs corresponding to the switch closures.

Figure 3:
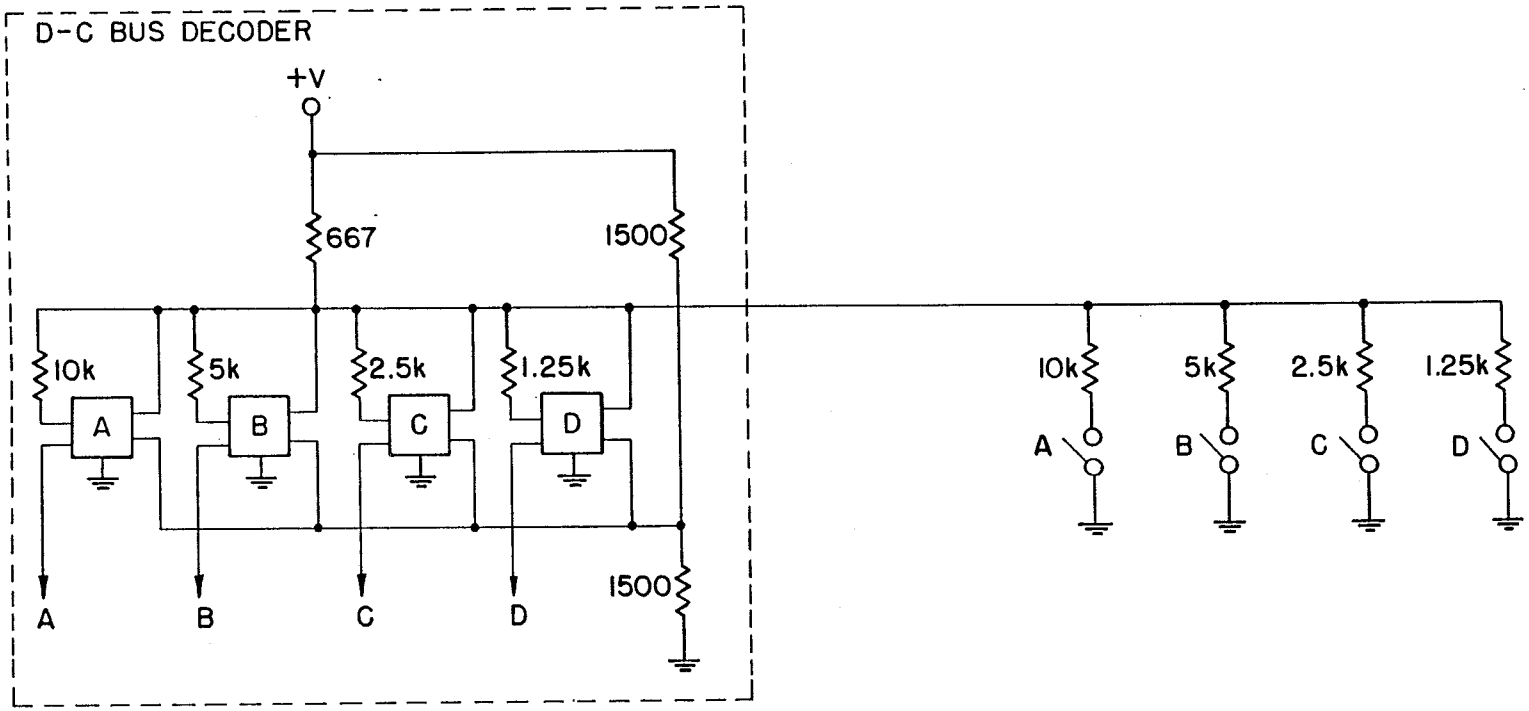
FIG. 3 is illustrative of the operating concept of a DC bus for discrete signals pursuant to the present invention.

FIG. 3 is illustrative of the operating concept for a DC bus for discrete signals pursuant to the present invention. In the circuit of FIG. 3, each switch is encoded by a resistor that is differentiated from other resistors by a power of two. For example, in FIG. 3:

| Switch | Resistor | |
|---|---|---|
| D | 1.25 k | |
| C | 2.5 k | $= 1.25\text{ k} \times 2$ |
| B | 5 k | $= 1.25\text{ k} \times 2^2$ |
| A | 10 k | $= 1.25\text{ k} \times 2^3$ |

This concept makes the parallel resistance value of any combination of switch closures unambiguous. A DC voltage is applied to the bus through a resistor, 667 ohms in FIG. 3, and this resistor and the coding resistors form a voltage divider circuit. The decoding circuits compare the voltage on the DC bus against a reference voltage generated by two reference resistors, 1500 ohm resistors in FIG. 3. The decoder circuits act to balance the DC bus voltage against the reference voltage. For example, if all of the switches are closed and then switch A is opened, circuit A detects the unbalance, and grounds a 10 k resistor to restore the balance. It should be noted that the decoder circuits do not all have to be in the same box. For example, in FIG. 3, switches C and D could be located on the left end of the DC bus and decoders C and D could be located at the right end, provided the reference voltage is supplied to all of the decoders.

Figure 4:
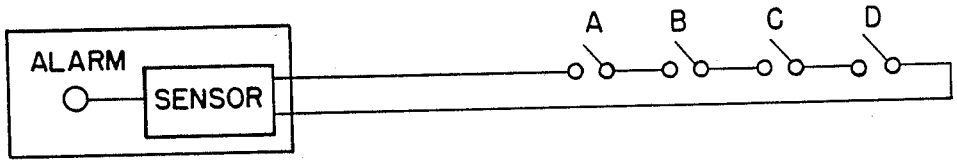
FIG. 4 shows a typical daisy-chain alarm or interlock circuit, as can utilize the teachings of the present invention.
Figure 5:
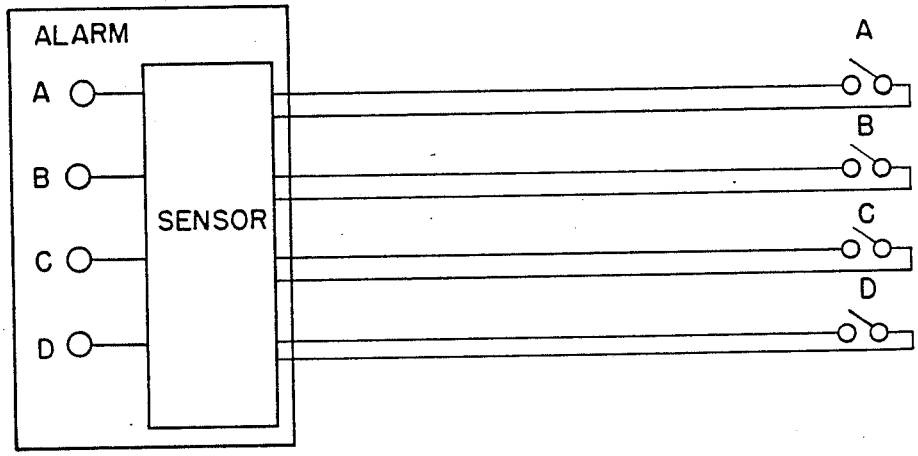
FIG. 5 illustrates a multiple station alarm or interlock circuit to identify individual switches.
Figure 6:
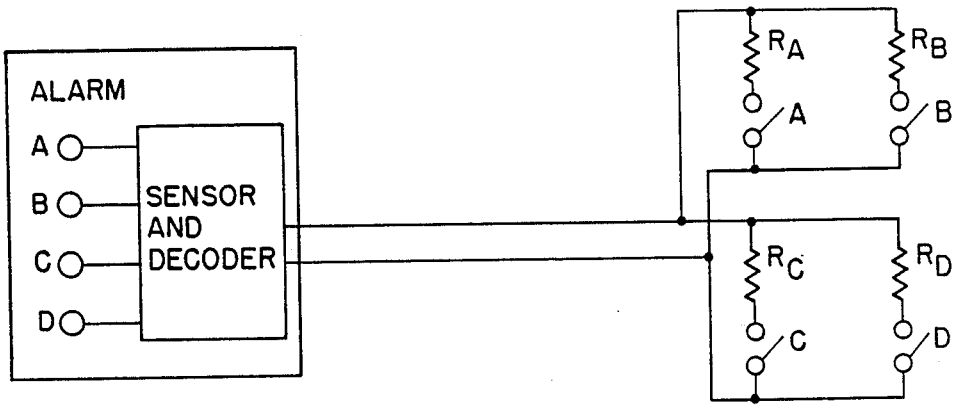
FIG. 6 shows a DC bus or interlock circuit which could be used with the present invention.

The present invention can also be used in alarm and interlock circuits. For example, FIG. 4 shows a typical daisy-chain alarm or interlock circuit as can utilize the teachings of the present invention. FIG. 5 illustrates a multiple station alarm or interlock circuit which can utilize the teachings of the subject invention to identify individual switches therein. FIG. 6 shows a DC bus circuit which could be used with the present invention. Referring to FIG. 6, only two wires are required (one if the structure can be used as a ground return). The circuit may be branched at any point for greater flexibility in wiring. Moreover, if the resistor is included in the switch, this circuit can provide greater security in an alarm circuit since shorting out the switch will not defeat the alarm.

There are some practical limitations on the number of switches which may be handled on a DC bus circuit pursuant to the present invention. The resistance of the largest coding resistor must be negligible relative to the input resistance of the decoder circuits (estimated 100 kohms). Also, the resistance of the smallest coding resistance must be much larger than the wiring and contact resistances of the circuit (estimated 100 ohms ).

Figure 7:
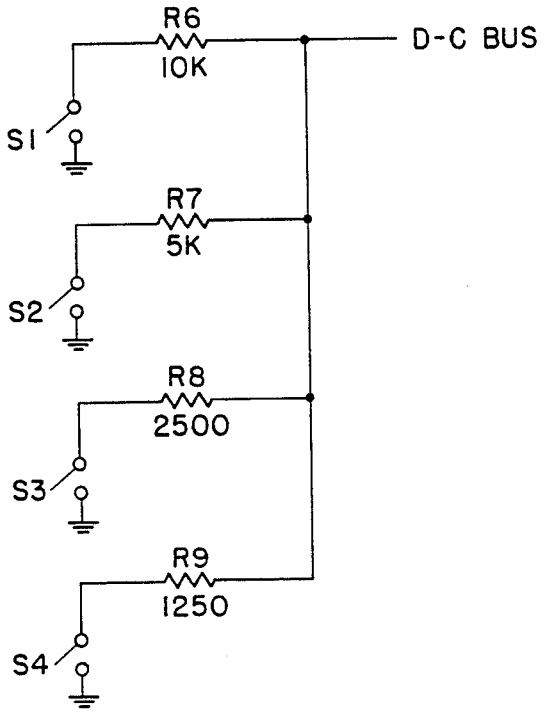
FIG. 7 illustrates an exemplary embodiment of a DC bus for discrete signals in which each signal source is encoded by a resistor that is some power of two times a reference resistor, and each signal source transmits its signal by grounding or ungrounding its resistor.

FIG. 7 illustrates another exemplary embodiment of the present invention in which switches S1–S4 represent four discrete signal sources. Resistors R6–R9 are the encoding resistors for each switch. Resistor R9 is nominally 1250 ohms. The nominal resistance of R8 (2500 ohms) is twice that of R9. The nominal resistance of R7 (5000 ohms) is twice that of R8 and the nominal resistance of R6 (10,000 ohms) is twice that of R7. With this selection of resistors, all of the possible combinations of switch postions represent a binary system wherein each combination of switch positions is equal to a unique resistance value. This is illustrated in Table I below.

TABLE I

SWITCH POSITIONS VS. EQUIVALENT RESISTANCE VALUES

0 = switch open
1 = switch closed

| S4 | S3 | S2 | S1 | Equivalent Resistance (ohms) |
|---|---|---|---|---|
| 0 | 0 | 0 | 0 | infinity |
| 0 | 0 | 0 | 1 | 10,000 |
| 0 | 0 | 1 | 0 | 5000 |
| 0 | 0 | 1 | 1 | 3333 |
| 0 | 1 | 0 | 0 | 2500 |
| 0 | 1 | 0 | 1 | 2000 |
| 0 | 1 | 1 | 0 | 1667 |
| 0 | 1 | 1 | 1 | 1429 |
| 1 | 0 | 0 | 0 | 1250 |
| 1 | 0 | 0 | 1 | 1111 |
| 1 | 0 | 1 | 0 | 1000 |
| 1 | 0 | 1 | 1 | 909 |
| 1 | 1 | 0 | 0 | 833 |
| 1 | 1 | 0 | 1 | 769 |
| 1 | 1 | 1 | 1 | 667 |

If a DC voltage is applied to the DC Bus through a resistor (such as 667 ohms), each combination of switch postions will produce a unique voltage on the DC Bus. If the voltages were linear, the DC Bus voltage could be read by an analog-to-digital circuit in the receiver to register which switches are open or closed. However, simple calculations reveal that the voltages would not be linear. Therefore, the bus slave circuit of FIG. 8 was designed.

Figure 8:
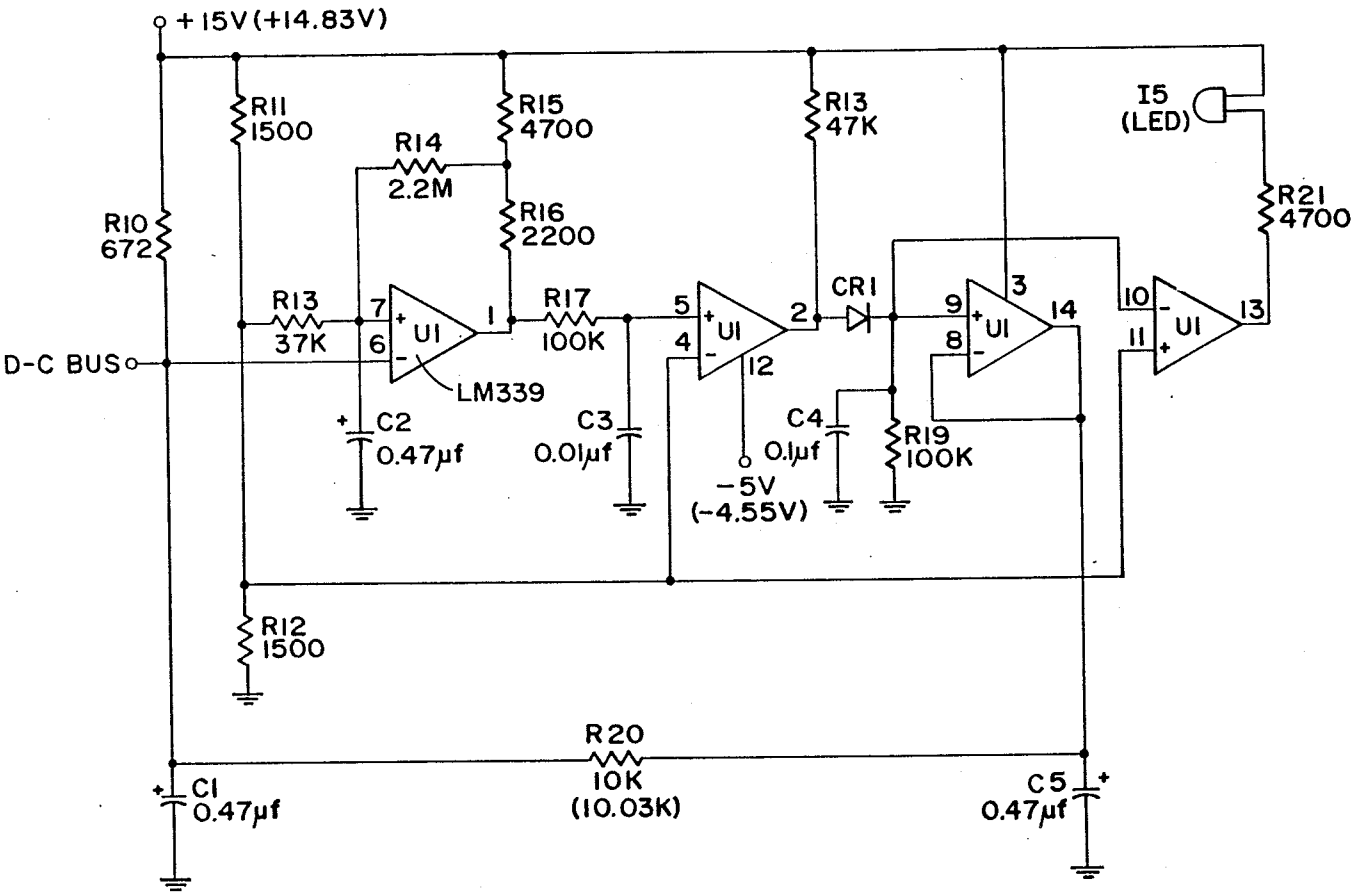
FIGS. 8, 9, 10 and 11 illustrate exemplary bus slave circuits for use in association with the DC bus for discrete signals of the present invention.

The bus slave circuit of FIG. 8 is designed to sense when the DC bus voltage goes above or below a fixed reference voltage by a certain tolerance voltage. The tolerance voltage provides a voltage range that allows for the tolerances of the encoding resistors and other components. When the DC bus voltage goes above or below the reference voltage tolerance range, the bus slave circuit switches to ground or ungrounded a resistor to return the DC bus voltage to the reference voltage.

The operation of the bus slave circuit can be observed from FIGS. 8 and 7. Assume U1-14 on quad voltage comparator U1 in FIG. 8 is high. Also assume that all the switches, S1–S4, in FIG. 7 are closed. This connects resistors R6–R9 in parallel to ground. Since the effective resistance of R6–R9 in parallel is approximately equal to R10 in FIG. 8 and R10 and R6–R9 form a voltage divider between +15 volts and ground, the DC Bus voltage is approximately 7.5 volts.

Resistors R11 and R12 form a voltage divider between +15 volts and ground. Since both R11 and R12 are 1500 ohms, the voltage at the junction of R11 and R12 must be 7.5 volts. If U1-14 is high, then U1-2 and U1-1 must also be high. Then there is no current flow through R16 into U1-1. Resistors R15, R14, and R13 then form a voltage divider between +15 volts and the voltage at the junction of R11 and R12, which is +7.5 volts. The current flow through R13, R14, and R15 is negligible so as not to effect the voltage divider R11 and R12. It may then be calculated that the voltage at U1-7 must be +7.630 volts. The DC bus is connected to U1-6, making the voltage at U1-6 +7.5 volts. This holds U1-1 high until the voltage on the DC Bus exceeds +7.630 volts.

It may also be calculated that the voltage at the junction of R14, R15, and R16 must be +14.984 volts. This voltage is applied to U1-5 through R16 and R17. Since U1-4 is connected to the junction of R11 and R12, which is at +7.5 volts, U1-2 must also be high. If U1-2 is high, +15 volts must be applied to U1-9 through R18 and CR1. If U1-14 is high, the DC bus voltage, +7.5 volts, must be applied to U1-8. This will then hold U1-14 high until the voltage on U1-9 drops below +7.5 volts.

If the voltage at U1-9 is about +15 volts, the voltage at U1-10 must be the same since they are connected together. Since U1-11 is connected to the junction of R11 and R12, the voltage on U1-11 must be +7.5 volts. This makes U1-13 low. As a result, current will flow through I5 and R21 into U1-13 to illuminate I5.

If S1 in FIG. 7 is opened, resistor R6 will be disconnected from ground. The parallel resistance of R7–R9 will be approximately 714 ohms and the DC bus voltage will become approximately +7.727 volts. This is above the 7.630 volts on U1-7 and therefore U1-1 will go low. When U1-1 goes low, the voltage at the junction of R16, R17 and U1-1 will go to approximately −5 volts. Capacitor C3 will discharge through R17 reducing the voltage on U1-5. When the voltage on U1-5 goes below +7.5 volts, U1-5 will go low (−5 volts). The charge on capacitor C4 will backbias CR1, and C4 will discharge to ground through R19.

When the voltage on U1-9 goes below the voltage on U1-8, U1-14 will attempt to go low. Since U1-8 and U1-14 are connected together, this will drop the voltage on U1-8 until the voltage on U1-8 goes below the voltage on U1-9, at which point U1-14 will attempt to go high again. The result is that this section of the voltage comparator will act as an operational amplifier, and the voltage on U1-8 and U1-14 will follow the voltage on U1-9. Capacitor C5 acts to damp out oscillations in the operational amplifier action.

When the voltage on C4 is discharged to ground through R19, the voltage on U1-9 and U1-14 will be at ground. The result is that R20 will then effectively be connected to ground. Resistor R20 will then be in parallel with resistors R7–R9 in FIG. 7 and the DC bus voltage will return to approximately +7.5 volts.

Since the voltage on C4 in FIG. 8 is now at ground, the voltage on U1-10 will be at ground while the voltage on U1-11 will be at +7.5 volts. This causes U1-13 to go high, cutting off the current flow through I5 and R21. I5 will go out. Thus, opening S1 in FIG. 7 will cause I5 in FIG. 8 to go out.

In the circuit of FIG. 8, I5 is used as an indicator. The same signal could also be used for a logic level input to a digital circuit.

When U1-1 goes low, R15 and R16 form a voltage divider between +15 volts and −5 volts. The voltage at the junction of R15, R16, and R14 will then be approximately 1.377 volts. Thus, as a result of the voltage divider action of R13 and R14, the voltage on U1-7 will be approximately +7.393 volts. Since this is below the +7.5 volts on U1-6, U1-1 will remain low until the voltage on U1-6 goes below +7.393 volts. Capacitor C2 is connected between U1-7 and ground to stabilize the switching action of this section of U1.

If switch S1 in FIG. 7 is closed, R6 will be placed in parallel with R7–R9 and R20 in FIG. 8. This will lower the DC bus voltage to +7.228 volts. Then the voltage on U1-6 will be below the +7.393 volts on U1-7 and U1-1 will go high. This will in turn raise the voltage on U1-5, which will cause U1-2 to go high. Then U1-9 will go high, causing U1-14 to go high, effectively ungrounding R20 and returning the DC bus voltage to +7.5 volts. U1-10 will also go high, causing U1-13 to go low. Current will then flow through I5 and R21 to U1-13, causing I5 to illuminate. Thus, when S1 in FIG. 7 is closed, I5 in FIG. 8 will light.

The bus slave circuit in FIG. 8 is designed to follow the operation of S1 in FIG. 7 which switches R6 in and out of the DC bus. Circuits were also designed to follow the operation of switches S2–S4 in FIG. 7. Table II lists these circuits with the corresponding switch designations and also the corresponding resistors for the switches and the circuits.

TABLE II

| BUS SLAVE CIRCUITS | | | | |
|---|---|---|---|---|
| Switch No. | Circuit Fig. No. | Switch Resistor | Circuit Resistor | Resistance (nominal ohms) |
| S1 | 8 | R6 | R20 | 10,000 |
| S2 | 9 | R7 | R30 | 5000 |
| S3 | 10 | R8 | R40 | 2500 |
| S4 | 11 | R9 | R50 | 1250 |

A comparison of FIGS. 8, 9, 10, and 11 will reveal that except for resistors R20, R30, R40, R50, R31, R32, and R41 and capacitors C6, C11, and C16, all four bus slave circuits are identical. As noted in Table II, resistors R20, R30, R40, and R50 match the corresponding DC bus resistors associated with switches S1–S4. Resistors R31, R32, and R41 are all 100 kohms connected between the DC bus and pin 6 of the LM339 voltage comparator. A similar resistor could have been used in FIG. 8 but is unnecessary. Capacitors C6, C11, and C16 provide different time delays for each circuit so that the circuits will search for the resistor combination that matches the switch postions in an orderly manner. This is illustrated as follows.

Figure 9:
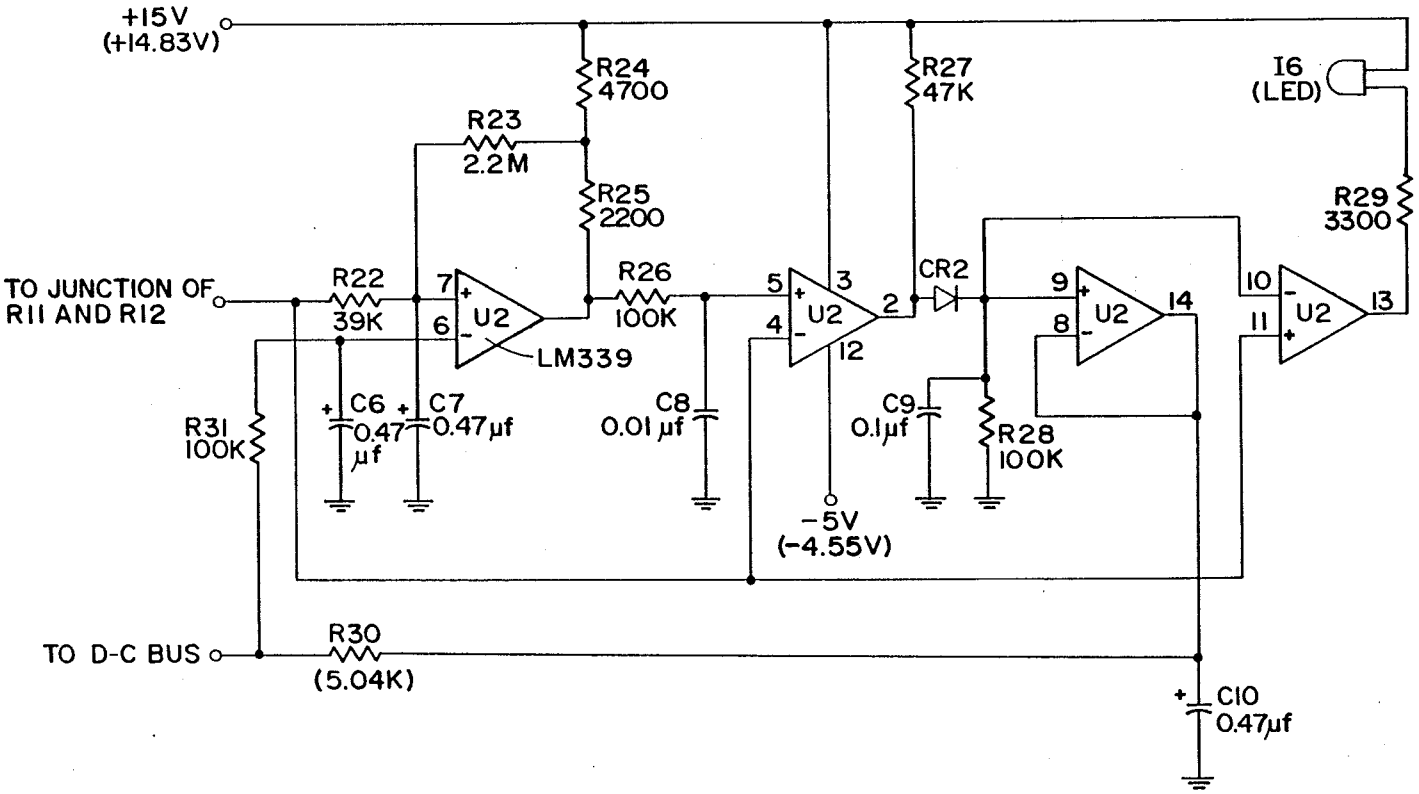
Figure 10:
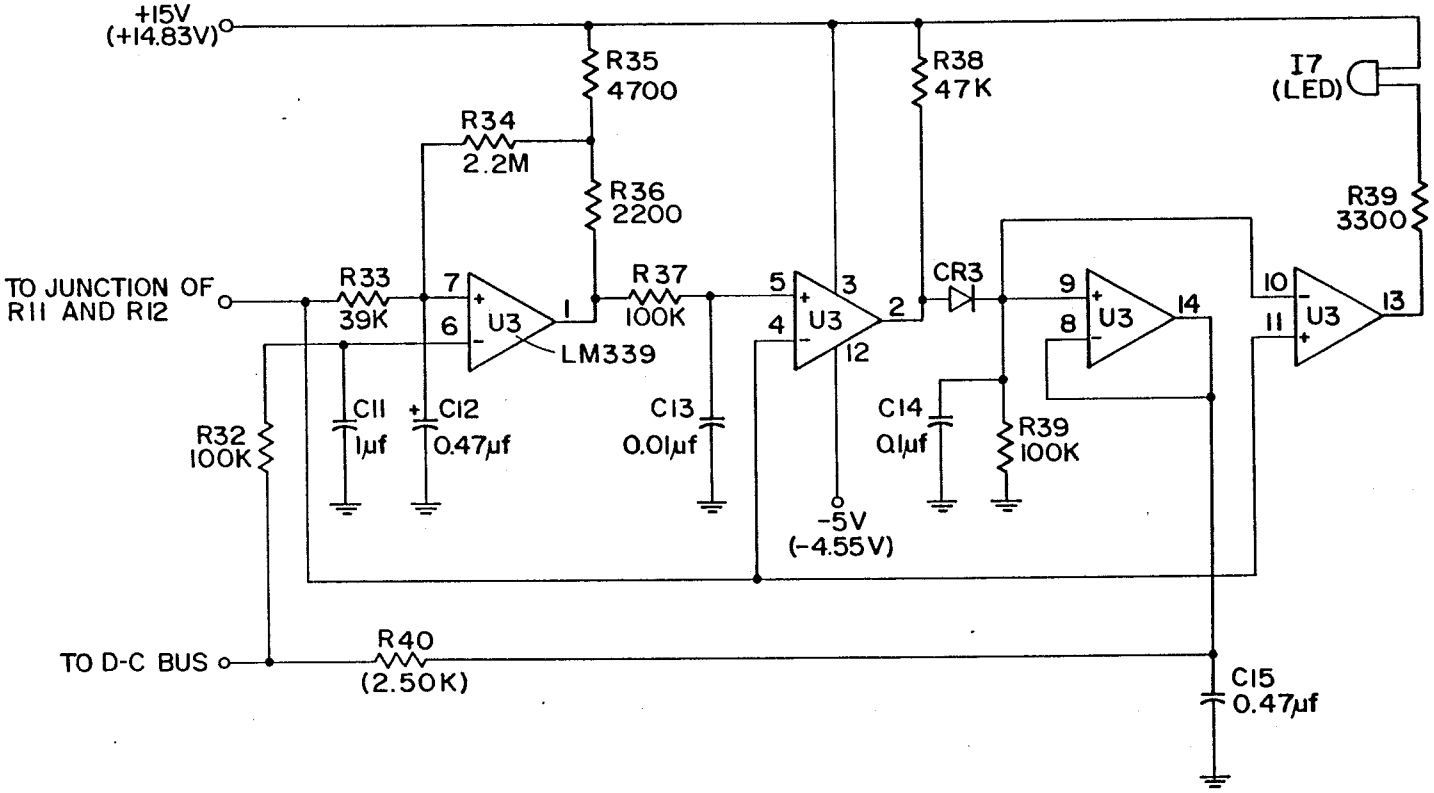
Figure 11:
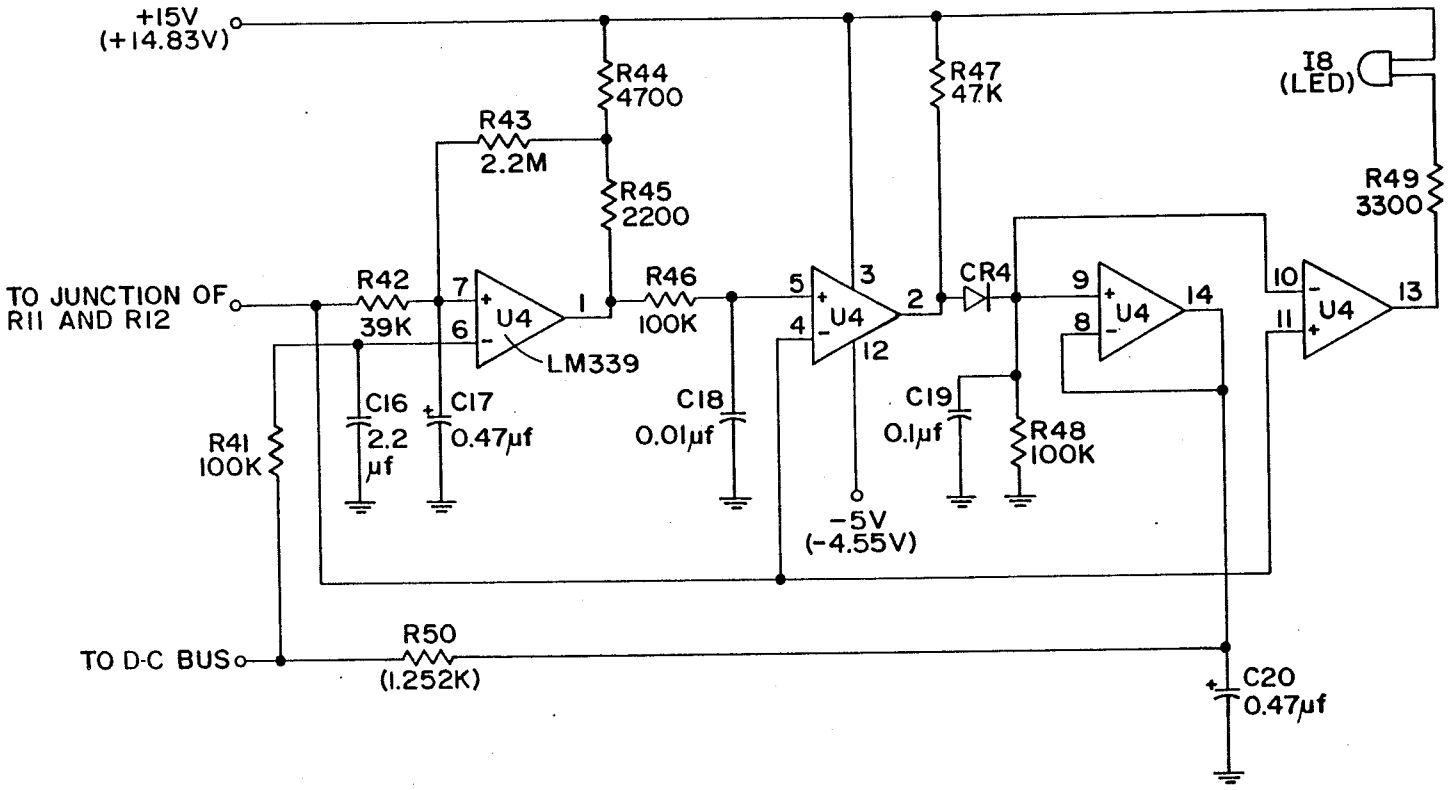

Assume switches S1–S4 in FIG. 7 are all closed. Then pin 14 on U1–U4 in FIGS. 8, 9, 10, and 11 will be high, and resistors R20, R30, R40, and R50 will be ungrounded. If S4 in FIG. 7 is opened, the DC bus voltage will go to +10.202 volts. Since pins 14 of U1–U4 are high, pins 7 of U1–U4 must be at +7.630 volts. When the DC bus goes to +10.202 volts, the bus slave circuit in FIG. 8 will switch to low, grounding R20 while capacitors C6, C11, and C16 in FIGS. 9, 10, and 11 are charging through R31, R32, and R41 respectively.

When R20 is grounded, the DC bus voltage will go to +9.755 volts. Capacitors C6, C11, and C16 will still continue to charge. Because C6 is smaller than C11 and C16, U2-6 will reach +7.630 volts before pins 6 on U3 and U4. The bus slave circuit in FIG. 9 will then switch to low, grounding R30.

When R30 is grounded, the DC bus voltage will go to +8.971 volts. Capacitors C11 and C16 will still continue to charge. Because C11 is smaller than C16, U3-6 will reach +7.630 volts before pin 6 on U4. The bus slave circuit in FIG. 10 will then switch to low, grounding 40.

When R40 is grounded, the DC bus voltage will go to +7.727. Eventually C16 will charge up to +7.630 volts and the bus slave circuit in FIG. 11 will switch to low, grounding R50.

When R50 is grounded, the DC bus voltage will go to +4.970 volts. Since the bus slave circuits in FIGS. 8, 9, 10, and 11 are all low, the pins 7 on U1-U4 will be at +7.393 volts. The bus slave circuit in FIG. 8 will switch to high while capacitors C6, C11, and C16 start to discharge. When the bus slave circuit in FIG. 8 goes high, resistor R20 will be ungrounded.

When R20 is ungrounded, the DC bus voltage will go to +6.220 volts. Capacitor C6 will discharge to +7.393 volts before C11 and C16. The bus slave circuit in FIG. 9 will switch to high ungrounding resistor R30.

When R30 is ungrounded, the DC bus voltage will go to +6.586 volts. Capacitor C11 will discharge to +7.393 volts before C16. The bus slave circuit in FIG. 10 will switch to high, ungrounding resistor R40.

When R40 is ungrounded, the DC bus voltage will go to +7.472 volts. Since this is above the +7.393 volts on U4-7, the bus slave circuit in FIG. 11 will not switch to high. If the bus slave circuit in FIG. 11 is high, I8 will be off, indicating that S4 in FIG. 49 is open. Similar logic may be followed for any combination of switch postions. It will be seen that in every case the bus slave circuits will follow their respective switches in FIG. 7.

In exemplary circuits, all four bus slave circuits were assembled on the same set of phototype wiring boards. It is possible to separate each bus slave circuit and locate each circuit at a remote location All that is required is that all the bus slave circuits must be provided with some common reference voltage, such as the 7.5-volts at the junction of R11 and R12 in FIG. 8. Thus, the discrete signal sources and the bus slave circuits may be located anywhere, connected only by one DC bus wire and one reference voltage wire for the bus slave circuits.

The prototype circuit had four switches and four bus slave circuits. In alternative embodiments more switches and bus slave circuits could be connected to the DC bus. The number of switches and bus slave circuits that could be used is limited by the resistance of the DC bus, the precision of the encoding resistors, and the sensitivity of the comparators. The values of the encoding resistors cannot become so low that the resistance of the DC bus is not negligible. The encoding resistances must be precise enough so that the resistance change due to the switching of the highest encoding resistor is not obscured by the tolerance of the lower resistor values. This also set limits on how high an encoding resistance can be used. The sensitivity of the comparators limits how high the resistance of the highest encoding resistors may become relative to the parallel resistance of the other encoding resistances. The higher the resistance of the encoding resistors are relative to the parallel resistance of the other encoding resistances, the smaller the voltage change when the highest encoding resistances are switched in and out of the circuit.

It is estimated that because of the foregoing factors, probably not more than eight to ten switches/bus slave circuits can be accommodated on a DC bus.

A primary use for the DC bus for discrete signals is on aircraft where the use of such a bus could save weight and wiring complexity. However, the same circuit could be used to reduce the wiring complexity of any system that uses many discrete signals.

In operation of the circuits of FIGS. 7-11, the following was observed:

| Switch | Lamp |
|---|---|
| S1-open | I5-off |
| S1-closed | I5-on |
| S2-open | I6-off |
| S2-closed | I6-on |
| S3-open | I7-off |
| S3-closed | I7-on |
| S4-open | I8-off |
| S5-closed | I8-on |

It was noted that when S4 was switched from open to closed with S1-S3 open, lamps I5-I7 momentarily blinked on. When S3 was switched from open to closed with S1 and S2 open, lamps I5 and I6 momentarily blinked on.

In the circuit of FIG. 11, a 1-Mohm resistor was inserted between pins 9 and 10 on U1 FIG. 10. A 0.1-uF capacitor was connected between pin 10 and ground. When S2, S3, or S4 were switched from open to closed with S1 open, lamp I5 did not blink. Switching S1 to closed caused I5 to go on.

A 1-Mohm resistor was inserted between pins 9 and 10 on U2 in FIG. 7. A 0.1-uF capacitor was connected between pin 10 and ground. When S3 or S4 were switched from open to closed with S2 open, lamp I6 did not blink. Switching S2 to closed caused I6 to go on.

A 1-Mohm resistor was inserted between pins 9 and 10 on U3 in FIG. 10. A 0.1-uF capacitor was connected between pin 10 and ground. When S4 was switched from open to closed with S3 open, I7 did not blink on. When S3 was closed I7 went on.

While several embodiments and variations of the present invention for a DC bus for discrete signals are described in detail herein, it should be apparent that the disclosure and teaching of the present invention will suggest many alternative designs to those skilled in the art.

What is claimed is:

1. A bus circuit for coupling multiple discrete signals from multiple discrete signal sources with multiple receivers remote from the signal sources, comprising:

a. multiple signal sources, each having two discrete positions or levels, such as opened or closed, and each signal source having an encoding impedance connected thereto, with no active components, and each encoding impedance having a discrete impedance value which is at least a power of two times a reference impedance, and each signal source transmitting its signal by grounding or ungrounding its encoding impedance; and b. multiple receivers at locations remote from said multiple signal sources and connected thereto by a common DC bus, and each receiver having a decoder circuit which compares the voltage on the DC bus with a reference voltage generated by the voltage drop across at least one reference impedance, and each receiver having a balance impedance equal to the encoding impedance for that receiver, and each receiver ungrounding or grounding the balance impedance in response to detection of its encoding impedance being grounded or ungrounded to restore the DC bus to a balanced voltage state.

2. A bus circuit for coupling multiple discrete signals from multiple discrete signal sources with multiple receivers remote from the signal sources, as claimed in claim 1, each impedance comprising a resistor.

3. A bus circuit for coupling multiple discrete signals from multiple discrete signal sources with multiple receivers remote from the signal sources, as claimed in claim 2, said reference voltage being generated by the voltage drops across a pair of reference resistors.

4. A bus circuit for coupling multiple discrete signals from multiple discrete signal sources with multiple receivers remote from the signal sources, as claimed in claim 1, said reference voltage being generated by the voltage drops across a pair of reference impedances.

* * * * *